United States Patent [19]

Talavera

[11] Patent Number: 4,509,725

[45] Date of Patent: Apr. 9, 1985

[54] CARPET REPAIR MECHANISM

[75] Inventor: Victor T. Talavera, Chicago, Ill.

[73] Assignee: Talavera Corporation, Chicago, Ill.

[21] Appl. No.: 455,340

[22] Filed: Jan. 3, 1983

[51] Int. Cl.[3] ..... A47G 27/04

[52] U.S. Cl. ..... 254/212

[58] Field of Search ..... 254/204, 205, 206, 207, 254/208, 209, 210, 211, 212

[56] References Cited

U.S. PATENT DOCUMENTS

| | | | |
|---|---|---|---|
| 416,383 | 12/1889 | Swart | 294/8.6 |
| 3,300,181 | 1/1967 | Spann | 254/212 |
| 3,945,609 | 3/1976 | Platek | 254/210 |
| 3,963,216 | 6/1976 | Victor | 254/209 |
| 4,230,302 | 10/1980 | Crain | 254/212 |

FOREIGN PATENT DOCUMENTS

| | | | |
|---|---|---|---|
| 2241747 | 12/1971 | Fed. Rep. of Germany | 254/212 |

*Primary Examiner*—Stuart S. Levy
*Assistant Examiner*—Joseph J. Hail, III
*Attorney, Agent, or Firm*—Allegretti, Newitt, Witcoff & McAndrews, Ltd.

[57] ABSTRACT

A mechanism for drawing adjacent sections of previously laid and stretched carpeting towards one another for purposes of repairing selected sections of the carpeting. The mechanism includes first and second frame sections which are movably interconnected to each other. Carpet engaging members are mounted on the second frame for selectively engaging one section of the carpet. A power member is operatively mounted on the first frame section and means are provided on the power member for selectively engaging a second section of the carpeting adjacent the second frame section. The carpet engaging means is movable in and out of engagement with the carpeting when the engaging means in the first frame section is in engagement with the carpeting. A drive section on the power member is movable from a first position to a second position by the use of external force, generally manual force. The carpeting sections are in their original positions with the power members in its first position and are in a drawn together position where the power member is forceably moved to the second position when both the engaging members are engaged with the carpeting so that the second frame section with the carpet engaging members thereon is moved toward the carpet engaging members provided on the second frame section in such a way the selected sections of carpeting to be repaired may be repaired when the carpet sections are in the drawn together position.

4 Claims, 7 Drawing Figures

CARPET REPAIR MECHANISM

BACKGROUND OF THE INVENTION

Field of the Invention and Description of the Prior Art

This invention relates to an improved mechanism for facilitating the repair of previously laid and stretched carpeting in such a way that the carpeting may be readily repaired in the middle of the floor while there is no need to disturb the previously secured edges thereof.

Carpeting is probably the most commonly used type of floor covering used for a wide range of purposes including for commercial purposes, industrial purposes, and for residential purposes. Many years ago, it was a common practice to install carpeting by using tacks to secure the carpeting to the floor. Today, it has become the common practice to use a "tackless" system for securing carpeting to the floor by using various types of special equipment. Generally, after the carpet padding has been installed on the raw floor, "tack" strips or wood strips having upwardly projecting teeth or barbs are fixedly secured to the periphery or edges of the area which is to be carpeted. The carpeting to be laid is cut to size in order to cover the desired area The outer peripheral edges of the carpeting are stretched by carpet stretching devices and the carpet periphery is placed into engagement with the teeth that project upwardly from the wood strips that are secured to the floor. Carpet stretching devices have been known and used for many years as seen for example, in the Swart U.S. Pat. No. 416,383. A preferred type of stretcher, however, is shown in Crain U.S. Pat. No. 4,230,302, the disclosure thereof being incorporated herein by reference. When stretching the carpeting, a wall engaging portion is provided on the carept stretcher and is used for fixed securement of one end of the stretcher against a wall. The stretcher devices also include a support member having downwardly projecting carpet engaging teeth which engage the upper surface of the outer periphery of a section of carpeting. A toggle mechanism is forcibly and manually operated to stretch the carpeting while the undersurface of the periphery of the carpeting is placed into engagement with the upwardly projecting teeth provided on the fixed wood strips that are mounted on the edges of the space to be covered.

Particularly after use, tears or rips may occur in the carpeting or there may be other types of damage, such as cigarette burns or the like. Also, the carpeting may have "ripples". Therefore, following installation, it often becomes necessary to repair sections of the carpeting. In order to accomplish the repair, in the inner sections of the carpeting, in particular, that is, away from the carpet periphery, it would be considered extremely inconvenient to physically disengage the peripheral edges of the stretched carpeting from the teeth provided on the wood securing strips. It is considered much more convenient to carry out the repair in a more simple manner. Generally, a repair of a seam or the like can be made if the tension of the stretched carpeting is releived in the area of the repair. There is one known device for physically drawing seam edges towards each other in order to repair carpeting. Such a device is shown in Spann U.S. Pat. No. 3,300,181 which enables the tension to be relieved in the region of the repair without disturbing the securement of the carpeting edges to the tack strip. However, it has been found that a device of this type after does not provide sufficient tension relief, with minimal manual effort, in order to accomplish the necessary freedom to sew or patch the area being repaired.

SUMMARY OF THE INVENTION

It is therefore an important object of the present invention to provide a unique mechanism for facilitating the repair of interior sections of previously laid and stretched carpeting wherein the mechanism is particularly simple and highly effective in use.

It is also an object of the present invention to provide an improved mechanism for drawing selected sections of carpeting together in order to repair selected portions thereof wherein the mechanism includes a power stretcher unit used in combination with a frame section attachable to the power stretcher wherein the mechanism, in combination, readily accomplishes the drawing of two sections of the carpeting together in order to relieve tension and enable a repair to be made on selected sections of the carpeting.

It is a further object of the present invention to provide a unique mechanism for faciliating the repair of carpeting by drawing sections of carpeting together wherein the device is characterized by its simplicity and economy of manufacture.

Further purposes and objects of the present invention will appear as the specification proceeds.

The foregoing objects are accomplished by providing a mechanism for drawing adjacent sections of previously laid and stretched carpeting towards each other for purposes of facilitating the repair of selected sections of carpeting, the mechanism including a frame assembly, preferably hving a first frame section, a second frame section movably interconnected to the first frame section, teeth being mounted on the second frame section for selectively engaging one section of the carpet, a power member operatively mounted on the first frame section, teeth being mounted on the power member for selectively engaging a section of the carpeting, the carpet engaging teeth being movable in and out of engagement with the carpeting when the engaging teeth on the first frame section are in engagement with the carpeting, a drive section on the power member being movable from a first position to a second position by use of external force, the carpeting sections being in their original positions when the power member is in its first position and being in a drawn together position when the power member is being forcibly moved to the second position, while both carpet engaging teeth sections are engaged with the carpeting so that the second frame section with the carpet engaging teeth are movable towards the carpet engaging means provided on the second frame section so that selected sections of carpeting are drawn together and the tension of the laid carpeting is sufficiently relieved to facilitate repair of selected carpeting sections.

BRIEF DESCRIPTION OF THE DRAWINGS

Referring to the accompanying drawings there is shown one particular embodiment of the present invention wherein.

DETAILED DESCRIPTION OF THE PREFERRED EMBODIMENT

Figure 2:
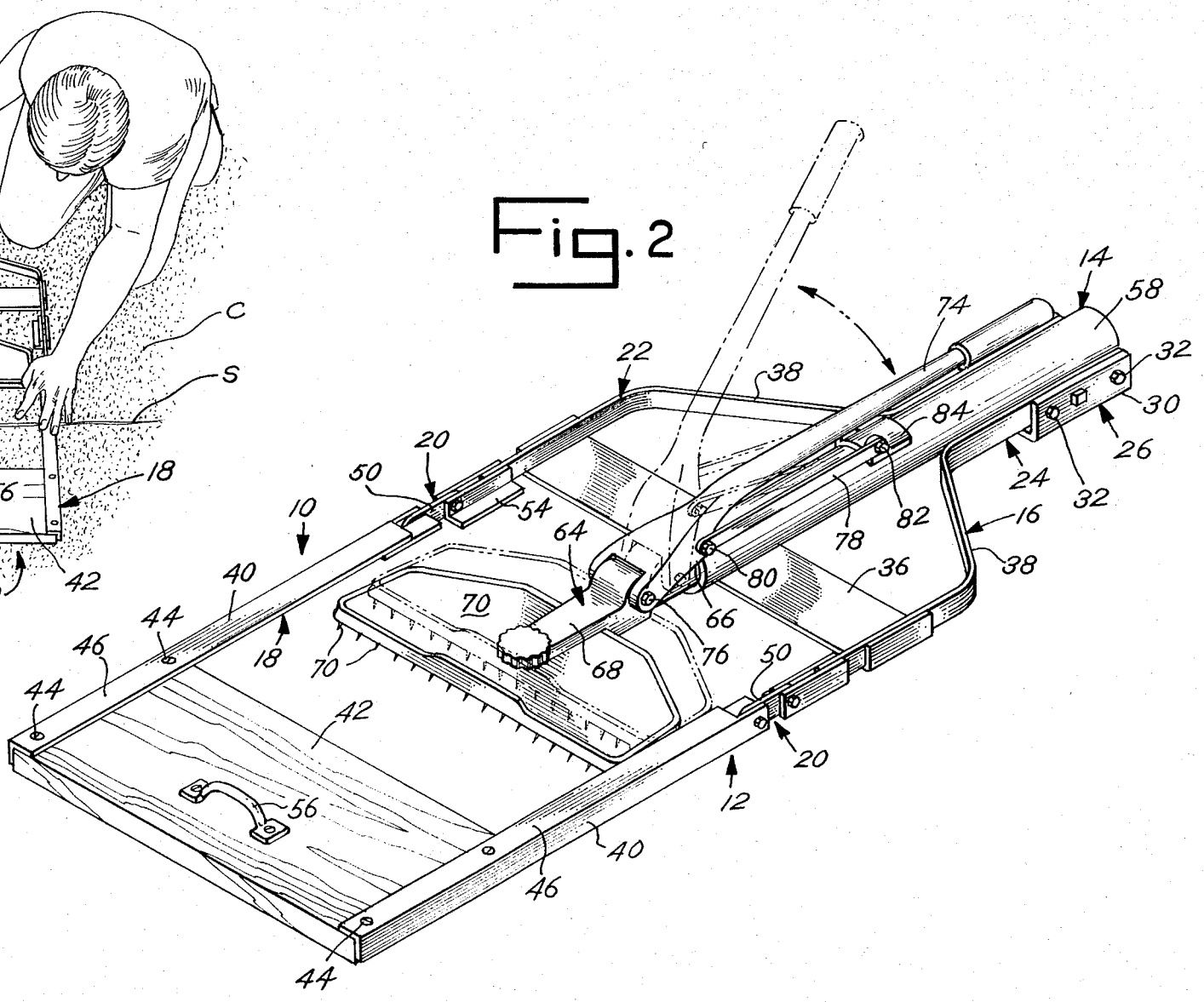
FIG. 2 is a pictorial view of our improved carpet repair mechanism as illustrated in FIG. 1.

Referring to the drawings, and particularly to FIG. 2, my improved mechanism, generally 10, for drawing sections of carpeting together in order to facilitate the repair thereof, is pictorially shown. The mechanism 10 generally includes a frame assembly section, generally 12, and an operatively interconnected power section, generally 14. The frame assembly section 12 which will be hereinafter described in detail, preferably, is an attachment that is separate and apart from the power section 14 and removably interconnected thereto. As described hereinafter, the power section 14 is a portion of a conventional carpet stretcher assembly of the type shown, for example, in the previously disclosed Crane U.S. Pat. No. 4,230,302, the disclosure which has been incorporated herein by reference.

Figure 3:
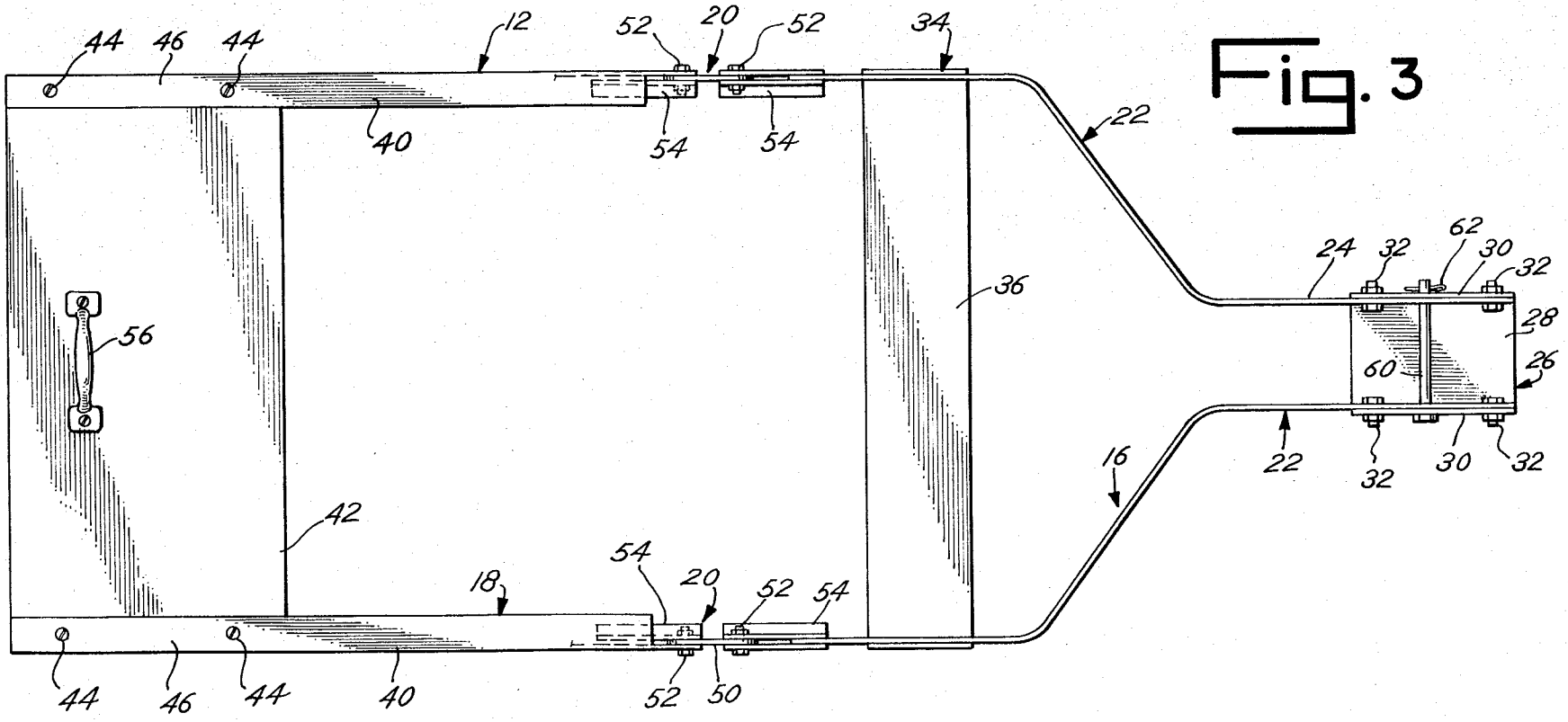
FIG. 3 is a top plan view of the carpet repair mechanism of FIG. 2, but without the carpet stretcher in place, as illustrated in FIG. 2.
Figure 4:
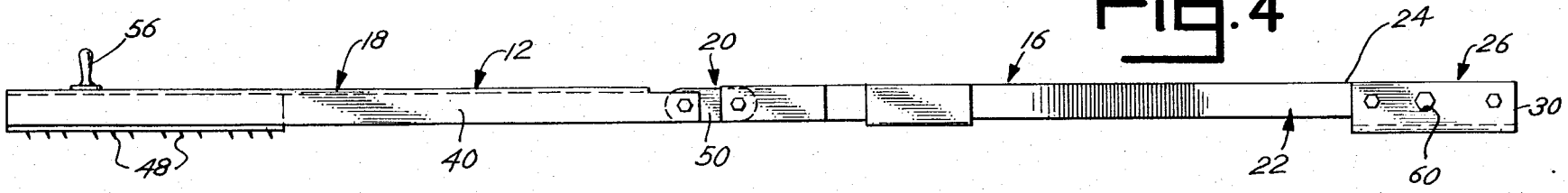
FIG. 4 is a side elevational view of the frame assembly embodied in FIG. 3.
Figure 5:
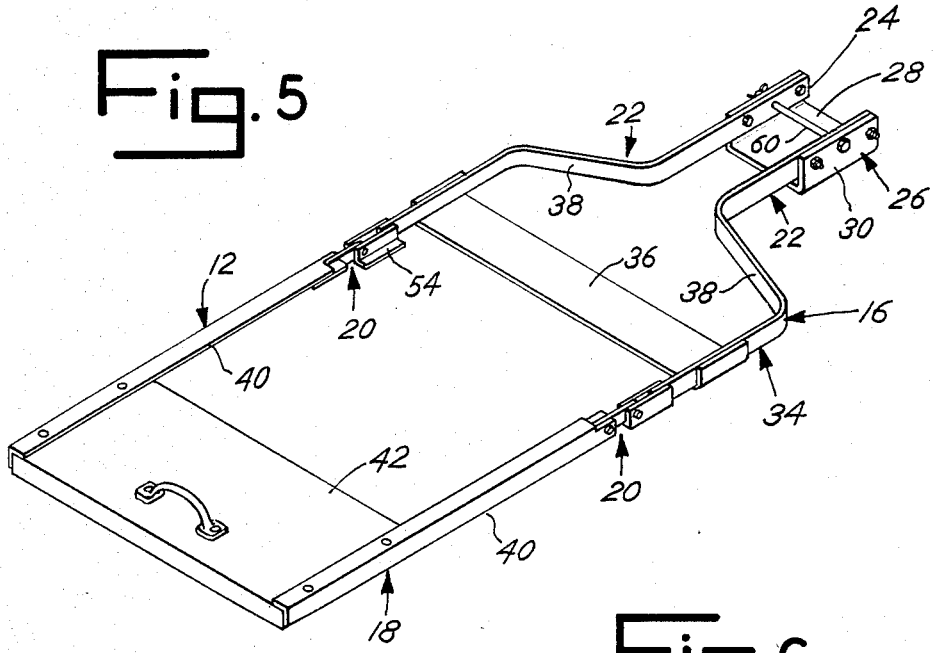
FIG. 5 is a pictorial view of the assembly shown in FIGS. 2–4.

The frame section 12, as seen best in FIGS. 3 and 4, includes a first frame section, generally 16, and a second frame section, generally 18. The first and second frame sections 16 and 18 are hingedly or pivotally interconnected to each other by a pair of spaced hinge sections, generally 20.

The first frame section 16 includes a pair of laterally spaced rigid and formed support bars 22, which are mirror images of each other. The formed support bars 22 cooperate to define an outer portion 24 for the frame section 16. The bars 22 at the outer section 24 are fixedly secured and spaced from each other by a U-shaped support member 26. The U-shaped support member 26 includes an intermediate web 28 and a pair of spaced, rigid legs 30 which project from the opposite ends of the web 28. Each leg 30 is positioned adjacent the outer portion 24 of each support bar 22, and is rigidly secured thereto by a plurality of bolts 32. The inner section 34 of the frame section 16 as defined by the spaced bars 22 includes a rigid support bar 36 which is secured to the support bars 22 by welding or similar securement. The support bars 22 at the outer section 24 are spaced relatively closer together than at the inner portion 34. In this regard, each support bar 22 includes an inwardly angled portion 38 which interconnects the outer portion 24 to the inner portion 34 of the frame 16.

Figure 6:
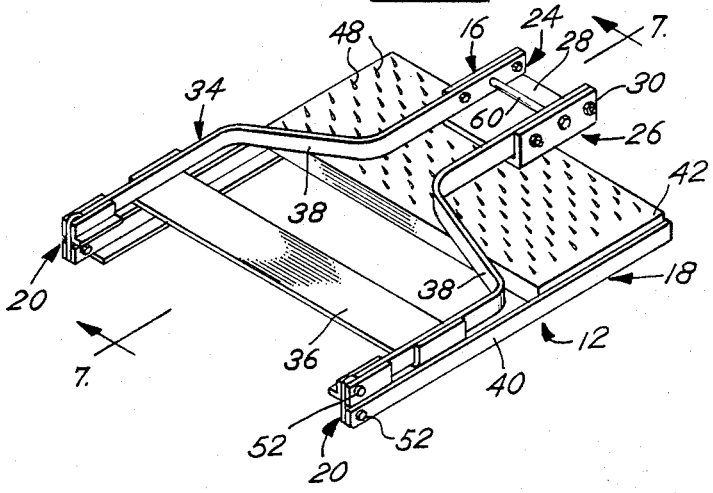
FIG. 6 is a pictorial view, similar to FIG. 5, showing the frame assembly in a folded position for storage or transportation.
Figure 7:
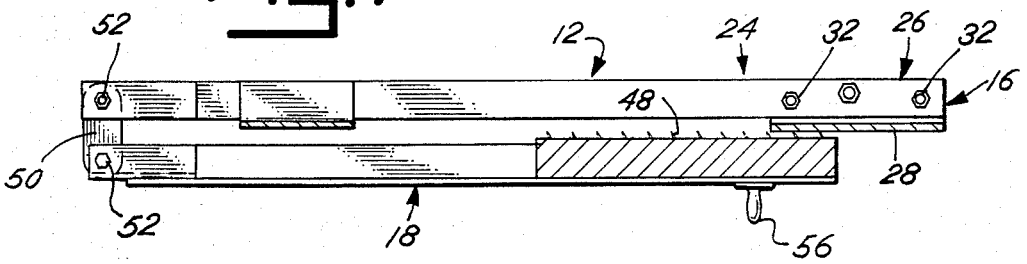
FIG. 7 is a enlarged sectional view of the frame assembly taken along the line 7—7 of FIG. 6.

The second frame section 18, as seen best in FIGS. 3 and 4, includes a pair of elongated outer L-shaped frame members 40 and an intermediate cross support member 42, which rigidly interconnects the outer ends of the elongated frame members 40. A cross support 42 is conveniently constructed of wood or any other rigid material and is fixedly secured to the frame members 40 by use of screws 44 or other suitable fasteners which are passed through the flanges 46 of the frame member 40 and are secured to the cross support member 42. As best seen in FIGS. 4, 6 and 7, the cross support member 42, in addition to providing rigidification for the frame section 18, includes a plurality of normally downwardly projecting teeth or barbs 48 which are constructed and arranged to physically engage the upper surface of the carpeting C, as pictorially illustrated in FIG. 1.

The hinge sections 20 are provided to hingedly or pivotally interconnect the first frame section 16 to the second frame section 18. Each hinge section 20 includes rigid link 50 having apertures in the opposite ends thereof which are sized to receive hinge pins 52 which are securely mounted at an end of each frame section 40 and at the adjacent end of each support bar 22. A rigidifying support assembly 54 is securely mounted at each end of each support bar 22 and at the end of each L-shaped frame member 40. As seen best in FIGS. 6 and 7, the hinge sections 20 enable the two frame sections 16 and 18 to be movable into a folded position in order to faciliate storage and carrying thereof. A handle 56 is preferably rigidly mounted on the cross support 42 in order to faciliate handling and carrying of the frame assembly 12.

The power section 14 of the mechanism 10 is illustrated in FIG. 2. Although the power section 14 may be permanently attached to the frame assembly 12, it is to be understood that the power section 14 is normally part of a carpet stetcher. As previously discussed, the carpet layer may use the stretcher assembly in combination with the frame assembly 12 in order to construct the unique mechanism 10. As used in the mechanism 10, the power section 14 includes a tubular support member 58 which is pivotally interconnected to the outer section 24 of the frame section 16 by a pivot pin 60 and is preferably removably secured by use of a locking pin 62, as seen in FIG. 3. The pivot 60 and pin 62 provide for removable and pivotal interconnection between the tubular support member 58 of the power section and the frame section 16.

The power section 14 further includes a support section, generally 64, which includes an elongated cylindrical section 66 which is slidably supported within the tubular support 58. The support section 64 further includes a forwardly projecting arm 68. A unitary support 70 is positioned at the outer end of the arm 68 and supports a plurality of downwardly projecting carpeting engaging teeth 72. A lever arm 74 is pivotally secured to the central section of the support 64 by a pivot pin 76. The pivot pin 76 supports the lever arm 74 for pivotal movement of the arm 74 for movement towards and away from the tubular support 58, as indicated by the arrows and dotted lines in FIG. 2. A pair of links 78 are pivotally secured, at one end, to the lever arm 74 at a position spaced upwardly from the pivot pin 76. The opposite end of each link 78 is pivotally secured to the tubular support 58 at a support member 84. The links 78 and lever arm 74 define a toggle mechanism used for applying manual power to operate the mechanism 10 in a manner to be hereinafter described.

Figure 1:
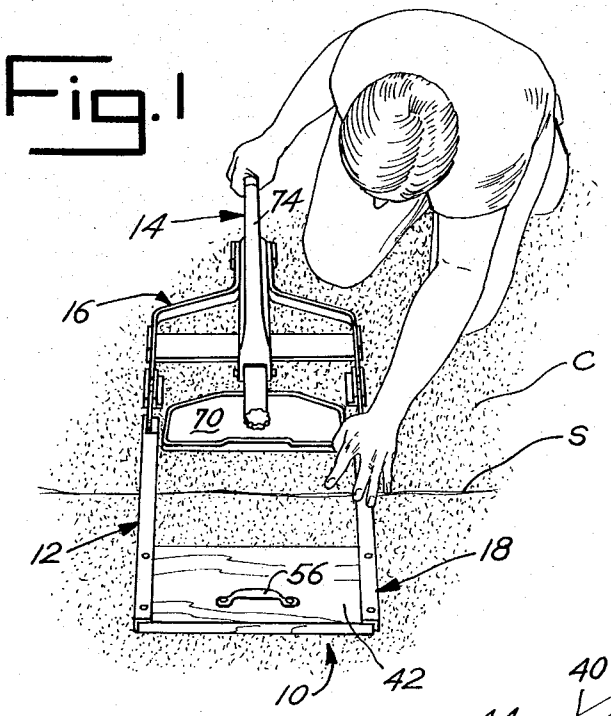
FIG. 1 is a pictorial view of my improved mechanism for facilitating the repair of carpeting shown in use for facilitating the repair of a seam in carpeting.

In use, and referring to FIG. 1, there is shown a separated seam S in the carpeting C. The carpetlayer places the mechanism 10 in the area to be repaired, generally by sewing the carpeting seam in the area of the tear. It is not necessary for the operator to unsecure outer peripheral edges of the carpeting C in order to relieve tension in the area to be sewn. It is to be understood that the mechanism 10 may be used for repairing a variety of carpeting problems, particularly in intermediate sections of the carpeting C, including tears, seam separations, holes, ripples, and the like. The operator first places the support 70 with the teeth 72 in engagement with the upper surface of the carpeting C on the operator's side of the seam S. When placing the support 70 in position, it is more convenient for the operator to grasp the handle 56 and pivot the frame section 18 upwardly and away from the carpeting surface C as it is easier to position one side of the mechanism 10, rather than both sides which is the reason why the frame assembly 12 preferably has two interconnected sections 14 and 16. Once the support 70 and teeth 72 are properly positioned on the operator's side of the seam S, the frame section 18 and support member 42 with the teeth 48 are pivoted downwardly until the teeth 48 engage the upper surface of the carpeting C on the side of the seam S opposite the operator. At this time, the lever arm 74 is in the raised or dotted line position as seen best in FIG. 2. At this time, the support 70 is in the retracted or dotted line position, also seen in FIG. 2. The operator then applies manual pressure to the upper end of the lever arm 74 pivoting the arm 74 downwardly towards the tubular support 58. The toggle mechanism created by the links 78 and the lever arm 74 then drives the support section 64 and support 70 forwardly. Since the teeth 72 engage the upper surface of the carpeting C, the carpeting C on the operator's side of the seam S is drawn towards the carpeting on the opposite side of the seam which remains in a fixed position because of the teeth 48 on the support 42 remain in engagement with the carpeting C. This relieves the tension of the carpeting in a limited section of the carpeting C, thereby enabling the operator to sew or otherwise repair the seam S. From the foregoing discussion, it is seen that all of the objects previously set forth have been accomplished.

While in the foregoing there has been provided a detailed description of one particular embodiment of the present invention, it is to be understood that all equivalents obvious to those having skill in the art are to be included within the scope of the invention as claimed.

What I claim and desire to secure by Letters Patent is:

1. A mechanism for drawing first and second adjacent sections of previously laid and stretched carpeting towards one another for purposes of facilitating the repair of a selected section of said carpeting, said mechanism comprising, in combination a frame assembly having first and second portions, the second portion having support bars, means for pivotally interconnecting said first and second portions together, means mounted on said first portion of said frame assembly for selectively engaging said first section of said carpet, wherein the engaging means comprises a support member and a plurality of projecting teeth thereon, a power member including a tubular support member, the tubular support member being removably and operatively, non-rotatably fixed to the support bars and the power member thereby being removably and operatively mounted in a fixed position on said second portion of said frame assembly wherein said support bars extend in a longitudinal direction of said tubular support member locating said pivotally interconnecting means remote from the position at which said tubular support member is fixed to said support bars, means on said power member for selectively engaging said second section of said carpeting in a position adjacent said second portion of said frame assembly, a drive section on said tubular support member of said power member movable from a first position to a second position by use of external force, said carpeting sections being in their original positions when said power member is in its first position and being in a drawn together position when said power member is forcibly moved to said second position while both of said carpeting engaging means are engaged with said carpeting, said carpet engaging means on said power member being movable towards said carpet engaging means provided on said frame assembly so that said selected section of said carpeting is more easily repairable when said carpeting sections are in said drawn together position.

2. The mechanism of claim 1 wherein said drive section of said power member comprises a toggle mechanism with a lever arm operatively connected thereto for manual operation of said toggle mechanism.

3. An attachment for operative interconnection with a power carpet stretching assembly, said attachment and said power stretching assembly cooperating for drawing first and second adjacent sections of previously laid and stretched carpeting to each other for purposes of facilitating repair of a section of carpeting located therebetween; said power assembly being of the type which includes a tubular support member, means for selectively engaging said second section of said carpeting, and a drive section on said tubular support member of said power assembly being movable from a first position to a second position by use of external force, said attachment comprising, in combination, a frame assembly having first and second portions, the second portion having support bars, means for pivotally interconnecting said first and second portions together, means on said first portion of said frame assembly for selectively engaging said first section of said carpet, wherein the means for selectivly engaging said first section of said carpet comprises a support member and a plurality of projecting teeth thereon, means for removably and operatively, non-rotatably fixing the tubular support member to the support bars, the power assembly thereby being removably and operatively, non-rotatably mounted in a fixed position on said second portion of said frame assembly wherein said support bars extend in a longitudinal direction of said tubular support member locating said pivotally interconnecting means remote from the position at which said tubular support member is fixed to said support bars, said means on said power assembly for selectively engaging said seocnd portion of carpeting being adjacent said second portion of said frame assembly, said carpeting sections being in their original position when said power assembly is in said first position and being in a drawn position when said power assembly is in said second position while said carpet engaging means are engaged with said carpeting so as to facilitate repair of said carpeting section when in said drawn together position.

4. A mechanism (10) for drawing first and second adjacent sections of previously laid and stretched carpeting towards one another for purposes of facilitating the repair of a selected section of said carpeting, said mechanism comprising, in combination:

a frame assembly (12) having a first frame section (16) and a second frame section (18), the first frame section (16) including a pair of laterally spaced, rigid and formed support bars (22), which define an outer portion (24) and an inner portion (34) of the first frame section (16), a support member (26) which fixedly secures and spaces the support bars (22) at the outer portion (24) of the first frame section (16), and a rigid support (36) fixedly secured to the support bars (22) at the inner portion

(34) of the first frame section (16), and the second frame section including a pair of elongated, rigid frame members (40) which have outer ends, and inner ends and an intermediate cross support (42) which rigidly interconnect the outer ends of the frame members (40);

a pair of spaced hinge sections (20) which hingedly and pivotally innerconnect the inner ends of the frame members (40) of the second frame section (18) to the support bars (22) at the inner portion (34) of the first frame section (16);

a plurality of projecting, carpet engaging teeth (48) on the intermediate cross support (42) of the second frame section (18);

a power section (14) including a tubular support member (58) removably and operatively, non-rotatably fixed to the support member (26) and thereby the support bars (22), a support section (64) having a section (66) slidably supported within the tubular support (58) and a projecting arm (68), a unitary support (70) positioned on the arm (68), a plurality of projecting, carpet engaging teeth (72) on the unitary support (70), a lever arm (74) pivotally secured to the support (64), links (78) pivotally secured to the lever arm (74) and pivotally secured to the tubular support member (58), the lever arm (74) and thereby the section (66), unitary support (70) and teeth (72) being movable from a first position to a second position by use of external force, said first and second carpeting sections being in their original positions when said lever arm (74) is in its first position and said first and second carpeting sections being in a drawn together position when said lever arm (74) is forcibly moved to said second position while both pluralities of teeth (48, 72) are engaged with said carpeting, said plurality of teeth (72) on said power section (14) being movable toward said plurality of teeth (48) provided on said frame assembly (12) so that said selected section of said carpeting is more easily repairable when said first and second carpeting sections are in said drawn together position.

* * * * *